US006200029B1

(12) United States Patent
Bonta

(10) Patent No.: US 6,200,029 B1
(45) Date of Patent: Mar. 13, 2001

(54) HEAT RETAINING CONTAINER AND METHOD OF FORMING SAME

(76) Inventor: David G. Bonta, P.O. Box 133, Perkinsville, VT (US) 05151

( * ) Notice: Subject to any disclaimer, the term of this patent is extended or adjusted under 35 U.S.C. 154(b) by 0 days.

(21) Appl. No.: 09/478,045

(22) Filed: Jan. 5, 2000

(51) Int. Cl.[7] ..... B65D 30/10
(52) U.S. Cl. ..... 383/110; 383/84; 383/111
(58) Field of Search ..... 383/110, 84, 111

(56) References Cited

U.S. PATENT DOCUMENTS

| | | | | |
|---|---|---|---|---|
| 2,257,517 | * | 9/1941 | Spotts | 383/110 X |
| 3,428,103 | | 2/1969 | Walsh . | |
| 3,938,726 | | 2/1976 | Holden, Jr. et al. . | |
| 4,185,673 | * | 1/1980 | Daniello | 383/110 X |
| 4,515,840 | * | 5/1985 | Gatward | 383/110 X |
| 4,528,694 | * | 7/1985 | Skovgaard | 383/110 X |
| 4,578,814 | | 3/1986 | Skamser . | |
| 4,671,393 | * | 6/1987 | Rainey | 383/110 X |
| 4,679,242 | * | 7/1987 | Brockhaus | 383/110 X |
| 5,180,075 | | 1/1993 | Montalbano . | |
| 5,445,286 | | 8/1995 | Guimarin . | |
| 5,568,877 | | 10/1996 | Rench . | |

FOREIGN PATENT DOCUMENTS

| | | | | |
|---|---|---|---|---|
| 0 301 148 | * | 2/1989 | (EP) | 383/110 |
| 2 034 279 | * | 6/1980 | (GB) | 383/110 |
| 2 163 724 | * | 3/1986 | (GB) | 383/110 |

* cited by examiner

*Primary Examiner*—Jes F. Pascua
(74) *Attorney, Agent, or Firm*—Fattibene & Fattibene; Arthur T. Fattibene; Paul A. Fattibene

(57) ABSTRACT

A heat retaining container for maintaining heated food warm for a considerable period of time and method of making same that includes an outer cover formed of a rectangular blank of sheet material having reversely folded marginal portions to define opposed end pockets, and an insulating liner formed by opposed sheets of heat reflecting material having sandwiched therebetween a layer of gas impervious cells or bubbles filled with a gaseous medium, e.g. air. The opposed ends of the liner are inserted into the opposed end pockets of the cover blank whereby the cover blank and liner are reversely folded to define overlying panel portions, one of said panel portions being slightly greater to define a flap for sealing the open end. The opposed side edges of the reversely folded blank are suitably secured together in the assembled position of the container, and a fastener is provided for securing the flap in the closed position.

5 Claims, 2 Drawing Sheets

HEAT RETAINING CONTAINER AND METHOD OF FORMING SAME

FIELD OF THE INVENTION

This invention is directed to a heat retaining container and more specifically to a readily inexpensive and reusable box-like container for effectively maintaining cooked foods, e.g. pizza, warm over a considerable period of time and method of forming same.

BACKGROUND OF THE INVENTION

Over the years, there has been an increasing demand of patrons ordering cooked food and/or meals for take-out and/or for delivery, e.g. pizza and the like, for a reliable and inexpensive container for storing and maintaining such cooked foods warm. Accordingly, there exists the problem of maintaining such foods in a heated state during the period that the cooked food, pizza and the like has been ordered to the time at which it is to be consumed. Heretofore, it is known that efforts have been made to provide a container for keeping such foods warm. Such known efforts are disclosed in U.S. Pat. Nos. 3,428,103; 3,938,726; 4,578,814; 5,180,075; 5,445,286 and 5,568,877. While these known insulated containers may be capable of maintaining a pizza warm for a limited period of time, their constructions are relatively complex and difficult to fabricate, thereby rendering them quite costly. Accordingly, there is a need for a more simplified means for containing and/or storing heated or cooked foods such as pizza in a manner whereby the pizza is maintained in a heated state over a considerable period of time that is relatively simple in construction and relatively inexpensive to fabricate.

SUMMARY OF THE INVENTION

An object of this invention is to provide a simplified insulated container which is relatively easy to fabricate from inexpensive materials, and yet capable of maintaining a pizza and the like in a heated state over a considerable period of time.

The foregoing objects and other advantages are attained by a container which includes an outer cover formed of a rectangular blank of foldable sheet material wherein the opposed marginal end portions of the blank are reversibly folded to define opposed end marginal pockets. An insulating layer formed of opposed sheets of a metallic foil material, e.g. aluminum foil, having sandwiched therebetween a layer of cellular material, e.g. bubble-like liner formed of opposed plastic sheets having defined therebetween a series of individual cells or pockets of entrapped air. The insulating layer is sized so as to conform substantially to the size and shape of the outer cover, whereby the opposed ends of the insulated layer are received and retained within the opposed corresponding end marginal pockets. The outer cover and insulating layer so disposed is then reversely folded along a transverse medial foldline to define opposed overlying panel portions whereby one panel portion is greater or longer than the other. The opposed side edges of the reversely folded panel portions of said cover and insulated liner are sealed or bonded together by suitable means, e.g. heat seal, adhesive, tape and/or the like. The extended portion of one of the reversely folded panel portions which extends beyond the end of the other panel portion is then reversely folded to define a closure flap. The marginal edge of the closure flap is provided with suitable fastening means for maintaining the closure flap in a closed or sealing position. The arrangement is such that a highly efficient, thermal insulating container is formed of relatively inexpensive materials which is simple to manufacture and positive in operation.

In an alternate arrangement, the outer cover in its folded position may be sealed along the opposed side edges after which the liner, as described herein, is inserted in its folded position into the preformed cover, whereby the opposed ends of the liner are tucked into the marginal pockets formed at the opposed ends of the cover.

IN THE DRAWINGS

DETAILED DESCRIPTION OF THE PREFERRED EMBODIMENTS

Figure 7:
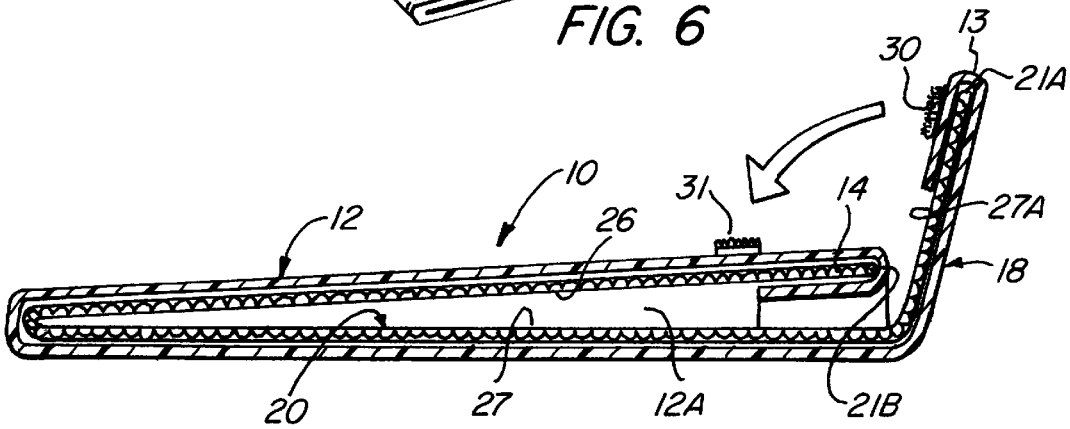
FIG. 7 is a sectional side view of the container embodying the invention in its assembled position.

Referring to the drawings, there is shown in FIG. 7 a cross-sectional view of an insulated container 10 embodying the present invention, which is particularly suitable for maintaining cooked foods, e.g. pizzas and the like, warm for a considerable period of time. While reference is made in particular to pizzas, it will be understood that the invention is useful for maintaining any type of cooked food products in a heated state that is required to be transported from the producer to the place where the cooked pizza or food is to be consumed.

Figure 1:
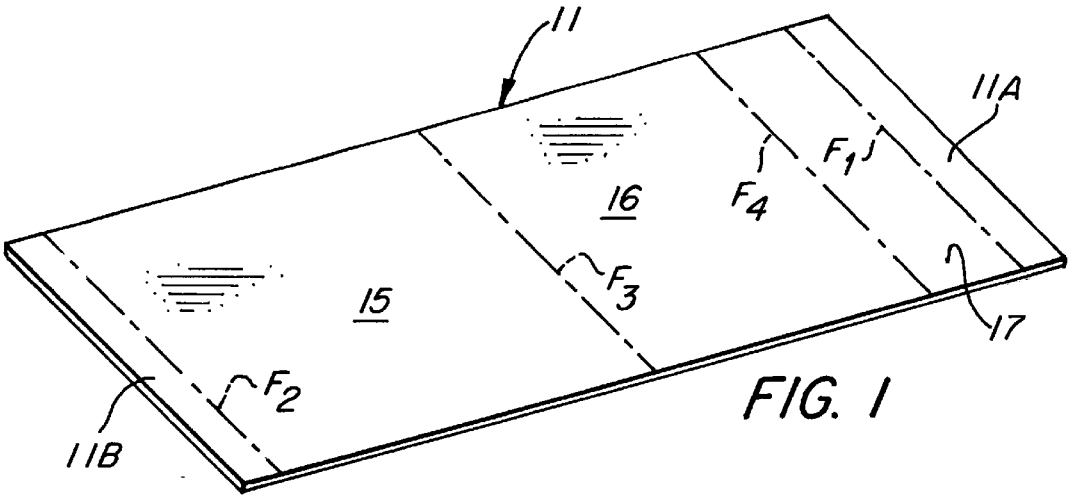
FIG. 1 is a perspective plan view of the outer cover blank.

FIG. 1 illustrates a rectangular blank 11 formed of foldable sheet material, e.g. vinyl plastic or the like, from which the outer cover 12 of the container 10 is formed. To form the outer cover 12 from blank 11, the opposed end marginal portions 11A and 11B are reversely folded along transversely extending foldlines $F_1$ and $F_2$ to define marginal end pockets 13 and 14, which are seamed at the opposed ends by suitable means such as stitching, adhesive, heat seal and the like. The blank 11 is also reversely folded along a medial transverse foldline $F_3$ to define overlying panel portions 15 and 16 respectively. As best illustrated in FIGS. 3 and 4, panel portion 16 is made a little larger than panel 16, i.e. panel portion 16 has an extending portion 17 which is adapted to be reversely folded about a transverse foldline $F_4$ to define a closure flap 18, as will be hereinafter described.

Figure 4:
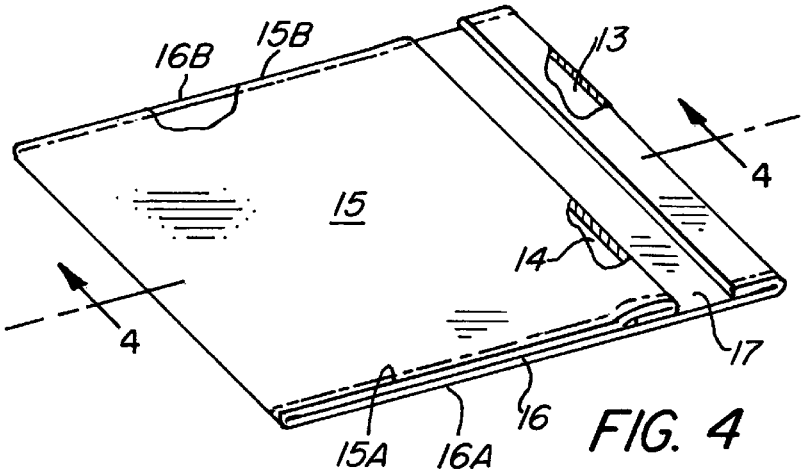
FIG. 4 is a perspective plan view of the blank forming the outer cover folded and sealed along the opposed side edges of the overlying panel portions.
Figure 3:
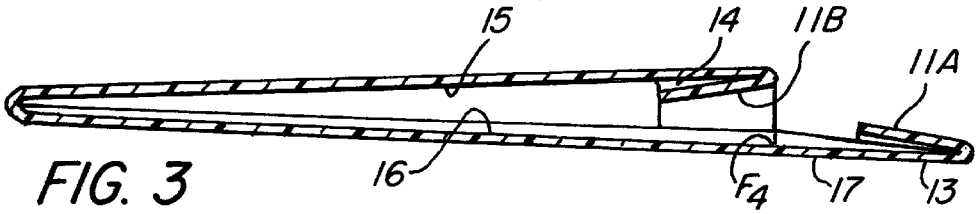
FIG. 3 is a sectional side view of the cover blank in its folded position.
Figure 2:
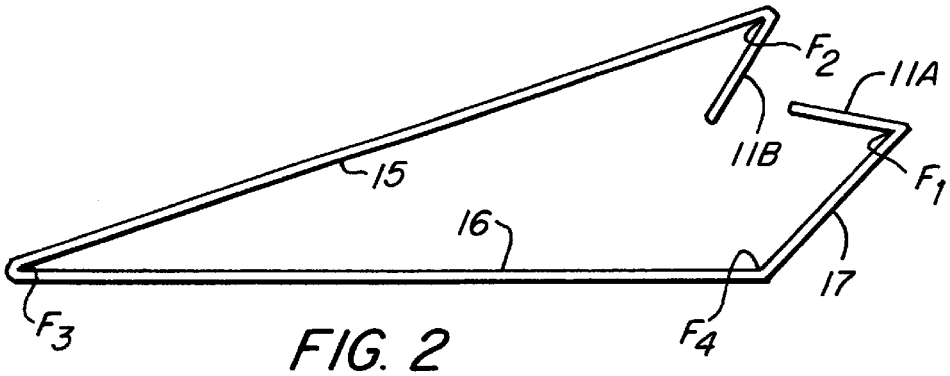
FIG. 2 is a side view of the outer cover illustrating the folds in forming the outer cover.

With the blank 11 folded, as shown in FIGS. 3 and 4, the opposed corresponding side edges 15A, 16A and 15B, 16B of the overlying panel portions 15 and 16 are secured or bonded together by any suitable means, e.g. heat sealing, adhesive bonding, sewing, taping, and/or the like to define a pocket 12A for receiving the cooked product or pizza.

Figure 5:
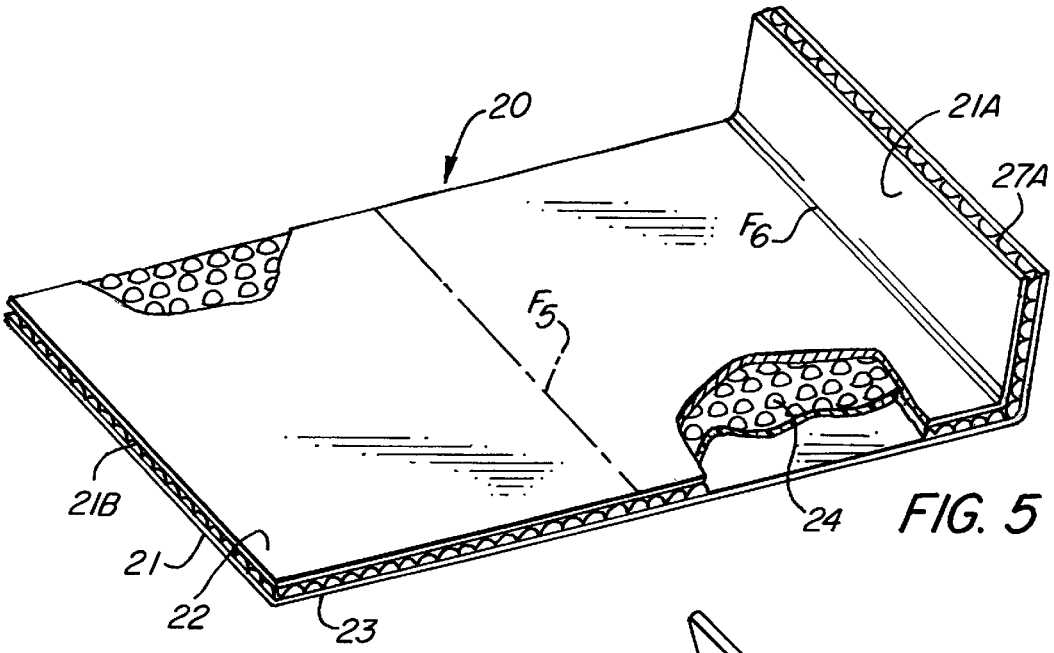
FIG. 5 is a perspective view of a blank from which a thermal liner is formed.

In accordance with this invention, a thermal liner 20 is provided. As seen in FIG. 5, the thermal liner 20 is formed as a blank 21 having a width sized to be received in the pocket 12A defined by the cover 12. The liner 20 as shown in FIG. 5 is formed by a pair of opposed sheets 22, 23 of a suitable heat reflecting material, as for example a metallic foil such as an aluminum sheet or the like, which has sandwiched or laminated therebetween a layer of cellular material 24. The cellular layer 24 may be formed of thin plastic sheets formed to define a plurality of gas impervious closed bubble-like cells containing an entrapped gas, e.g. air. The sandwiched insulating blank 21, so formed, is reversely folded about a transverse foldline $F_5$ to define overlying panels 26, 27, panel 27 having an extended portion 27A sized to substantially coincide with the closure flap 18. It will be noted that the extended portion 27A of the liner 20 is arranged to be reversely folded about a transverse foldline $F_6$.

Figure 6:
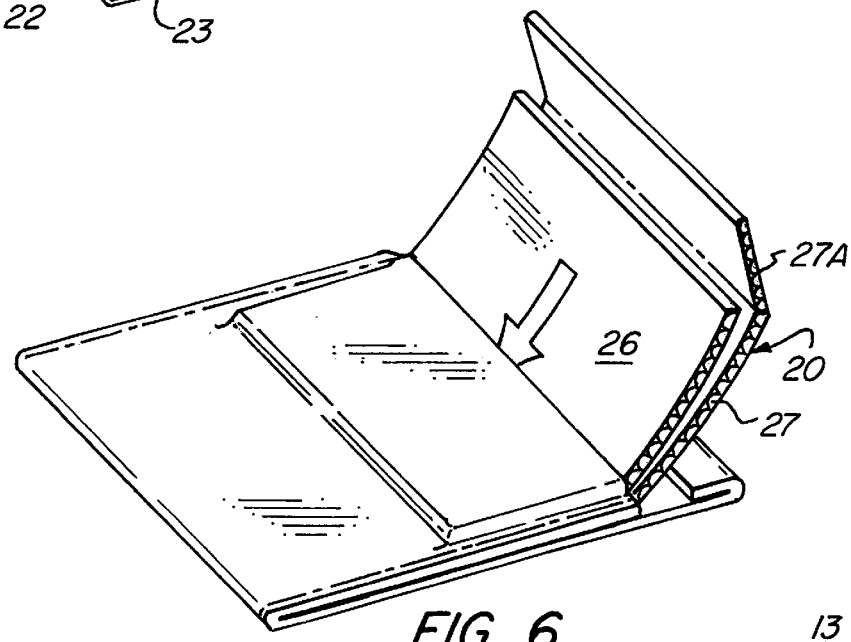
FIG. 6 is a perspective view illustrating the insertion of the liner into the outer cover.

With the liner 20 reversely folded about foldline $F_5$ as best seen in FIG. 6, the reversely folded liner 20 can be readily inserted into pocket 12A defined by the cover 12, whereby the liner 20 is retained within the cover 12 by inserting the opposed ends 21A, 21B into the opposed marginal pockets 13 and 14, as best seen in FIG. 7.

The arrangement described provides an envelope type container in which a cooked pizza can be readily slipped into the pocket 12A, whereupon the closure flap 18 can be readily folded over to seal the container 12. A suitable fastener, e.g. VELCRO i.e. complementary hook and loop, type fastener whereby a strip 30 of the hook portion of such VELCRO type fastener is connected to the outer edge of the closure flap 18 and the complementary strip 31 of the loop portion of the Velcro fastener being attached to a margin portion of panel 15, as best seen in FIG. 7.

It will be understood that the insulated container 12 may be made in varying sizes to accommodate the standard pizza sizes, e.g. 12, 14, 16 inch size pizza or larger sizes. Also, the pocket 12A may be sized to receive the cardboard boxes that such pizzas are customarily packaged in or the pizzas may be slipped into pocket 12A directly.

In another form of the invention, the insulating liner 20, as described herein, may be disposed in overlying position relative to the blank 11 forming the outer cover prior to the folding of the cover blank. Thus, with the insulating liner 20 disposed in overlying relationship of the cover blank 11, as seen in FIG. 1, the marginal end portions 11A and 11B of the cover blank 11 can be reversely folded about their respective foldlines $F_1$ and $F_2$ to overlie the opposed ends 21A and 21B of the insulated liner 20 disposed in overlying relationship therewith. With the liner 20 so secured to the cover blank 11, the blank 11, together with the liner 20, are reversely folded about their respective medial foldlines $F_3$ and $F_5$ into overlying position, whereby the opposed side edges of the reversely folded cover and liner may be sealed or secured together as hereinbefore described, to complete the container. In all other respects, the alternate construction is similar to that previously described.

From the foregoing, it will be apparent that a relatively simple insulated container can be readily fabricated from a die cut blank 11 of a suitable sheet of foldable material to define an outer cover which, together with a blank of a thermal insulated layer 20, can be readily folded into a container for receiving heated food products such as pizza and the like, in a simple and expedient manner. The container described is rendered reusable either by the consumer and/or the producer of the heated food product. It is understood that the container 10 described is sufficiently large so as to receive the cardboard box in which a pizza is normally boxed, whereby the customary pizza box imparts structural rigidity to the container.

While the present invention has been described with respect to a particular embodiment, modifications and variations may be made without departing from the spirit or scope of this invention.

What is claimed is:

1. An insulated container for maintaining heated food warm over a period of time comprising:

an outer cover formed of a blank of readily foldable material, said blank having its opposed end portions reversely folded to define opposed end pockets, said blank being reversely folded about a transverse medial foldline to define overlying panels whereby one of said overlying panels includes an extended portion, an independent insertable thermal liner having a size substantially co-extensive in length and width of said overlying panels of said outer cover blank, said thermal liner being reversely folded about a transverse foldline and having its opposed ends removably inserted into said end pockets, and means for securing together the outer side edges of said overlying panels of said reversely folded cover blank, said extended portion of said cover blank defining a closure flap, and fastening means for securing said closure flap to the other panel defined by said blank in the closed position.

2. An insulated container as defined in claim 1 wherein said outer cover is formed of a plastic sheet.

3. An insulated container as defined in claim 1 wherein said thermal liner comprises:

opposed sheets of a metallic foil, and a layer of cellular material sandwiched between said opposed sheets of metallic foil.

4. An insulated container as defined in claim 3 wherein said layer of cellular material includes a plurality of gas impervious cells containing an entrapped gaseous medium.

5. An insulated container as defined in claim 4 wherein said gas medium is air.

* * * * *